US007772982B2

(12) United States Patent
Feibelman et al.

(10) Patent No.: US 7,772,982 B2
(45) Date of Patent: Aug. 10, 2010

(54) ANTI-THEFT TAG

(75) Inventors: Jeffrey A Feibelman, Providence, RI (US); David Brown, Cumberland, RI (US)

(73) Assignee: Display Technologies, Inc., Johnston, RI (US)

( * ) Notice: Subject to any disclaimer, the term of this patent is extended or adjusted under 35 U.S.C. 154(b) by 536 days.

(21) Appl. No.: 11/800,103

(22) Filed: May 4, 2007

(65) Prior Publication Data

US 2008/0272917 A1 Nov. 6, 2008

(51) Int. Cl.
*G08B 13/14* (2006.01)

(52) U.S. Cl. ..... 340/572.8; 340/572.9

(58) Field of Classification Search ..... 340/572.8, 340/572.9
See application file for complete search history.

(56) References Cited

U.S. PATENT DOCUMENTS 3,760,466 A 9/1973 LeBlanc
4,331,394 A 5/1982 Girard
4,336,087 A 6/1982 Martuch et al.
4,636,271 A 1/1987 Gandolfo
4,991,413 A * 2/1991 Arnaldo ..... 70/19
5,119,652 A 6/1992 Costa
5,144,820 A 9/1992 Holmgren
5,337,503 A 8/1994 Goby
5,387,012 A 2/1995 Hibbs
5,437,172 A 8/1995 Lamy et al.
5,524,463 A 6/1996 Schenkel et al.
5,537,765 A 7/1996 Liebman et al.
5,570,080 A 10/1996 Inoue et al.
5,583,489 A * 12/1996 Loemker et al. ..... 340/572.8
5,627,520 A 5/1997 Grubbs et al.
5,646,592 A 7/1997 Tuttle
5,775,018 A 7/1998 Steinborn
5,791,079 A 8/1998 Mazzucchelli
5,848,488 A 12/1998 Norwood
5,910,768 A 6/1999 Ott
5,969,613 A 10/1999 Yeager et al.
5,982,282 A * 11/1999 Ryan, Jr. ..... 340/572.1
6,023,864 A 2/2000 Liebenow
6,091,333 A * 7/2000 Oshima ..... 340/572.1
6,120,146 A 9/2000 Harris
6,145,167 A 11/2000 Brentini
6,263,546 B1 7/2001 Baldwin et al.
6,276,033 B1 8/2001 Johnson et al.
6,278,413 B1 * 8/2001 Hugh et al. ..... 343/818
6,317,046 B1 11/2001 Fresnel et al.

(Continued)

*Primary Examiner*—Daniel Wu
*Assistant Examiner*—Brian Wilson

(57) ABSTRACT

An anti-theft tag includes a body that carries an EAS sensor, a shrinkable sleeve disposed about the outside of the body, an adhesive material disposed on the body between the body and the sleeve, and a sleeve holder extending from the body. The sleeve holder is constructed and arranged to hold the sleeve on the body such that a portion of the sleeve and the body define an aperture configured to receive an elongate article, such as an arm from a pair of eyeglasses. In use, once the anti-theft tag is disposed on the article, an assembler shrinks the sleeve to secure the anti-theft tag to the arm. In such a configuration, the sleeve and adhesive material holds the body of the anti-theft tag against the arm, thereby limiting the ability for a thief to remove the anti-theft tag from the elongate article by twisting or rotating the anti-theft tag relative to the article.

22 Claims, 6 Drawing Sheets

U.S. PATENT DOCUMENTS 6,330,758 B1 12/2001 Feibelman
6,342,838 B1 * 1/2002 Kolton et al. ..... 340/572.1
6,374,647 B1 4/2002 Holmgren
6,433,686 B1 * 8/2002 Feibelman ..... 340/572.8
6,518,888 B1 2/2003 Kolton et al.
6,567,003 B2 5/2003 Kolton et al.
6,589,067 B1 * 7/2003 Kolton et al. ..... 439/491
6,612,139 B1 9/2003 Costa
6,631,629 B1 * 10/2003 Fuss et al. ..... 70/57.1
6,696,955 B2 * 2/2004 Kolton et al. ..... 340/572.8
7,363,783 B2 * 4/2008 Kolton et al. ..... 70/57.1
2007/0273535 A1 * 11/2007 Kolton et al. ..... 340/572.8
2008/0061987 A1 3/2008 Kolton et al.
2008/0122633 A1 * 5/2008 Tetiyevsky ..... 340/572.9
2009/0128331 A1 * 5/2009 Lopez et al. ..... 340/572.1

* cited by examiner

ANTI-THEFT TAG

BACKGROUND

The theft of small articles in retail establishments is a prevalent problem which costs merchandisers millions of dollars every year in losses. Additionally, controlling this type of theft can be very difficult since a thief can remove the small articles from an establishment without paying for them by simply wear or concealing the items prior to exiting the establishment.

Various devices have been utilized by retailers in order to prevent theft of their goods. For example, a widespread practice in the industry of article security is the use of anti-theft tags which incorporate electronic article surveillance (EAS) sensors. Such EAS sensors are typically secured to an article and are either removed by a store's employee or are rendered inactive by an employee at checkout. If the EAS sensors are not rendered inactive or removed prior to the customer exiting the store, the EAS sensors are typically sensed in the store by an associated EAS system that, in turn, causes an alarm to signal.

SUMMARY

For many products, electronic sensors have been very effective in deterring theft. However, certain conventional EAS sensors suffer from a variety of deficiencies. For example, certain EAS sensors can be difficult to attach to certain types of merchandise. In particular, EAS sensors can be difficult to attach to eyeglasses because of the limited areas on which the EAS sensors can be disposed. For example, certain EAS sensors can be secured to, and hang from, a nose bridge portion of a pair of eyeglasses. However, these EAS sensors can hamper a customer's ability to try on the eyeglasses, as the sensor makes it difficult for the customer to properly seat the glasses on his or her face. Additionally, such hanging EAS sensors can, in certain instances, be easily removed from the eyeglasses by a customer prior to checkout. As a result, the eyeglasses can be removed from the store by the customer without payment and without causing the store's EAS system to generate an alarm.

By contrast to conventional EAS sensors, embodiments of the present invention relate to an anti-theft tag that is securable to an article, such as a pair of eyeglasses, and that minimizes the ability for a thief to readily remove the anti-theft tag from the article prior to exiting an establishment. For example, the anti-theft tag includes a body that carries an EAS sensor, a shrinkable sleeve disposed about the outside of the body, an adhesive material disposed between the body and the shrinkable sleeve, and a sleeve holder extending from the body. The sleeve holder is constructed and arranged to hold the sleeve on the body such that a portion of the sleeve and the body define an aperture configured to receive an elongate article, such as an arm from the pair of eyeglasses. The shrinkable sleeve and the adhesive material help to limit or prevent lateral translation of the anti-theft tag along a longitudinal axis of the article once secured thereto. For example, in the case where the anti-theft tag is secured to an arm of a pair of eyeglasses, the combination of the shrinkable sleeve and the adhesive material limits the ability for a thief to remove the anti-theft tag from the eyeglasses.

In use, the assembler can dispose the anti-theft tag onto the arm of the pair of eyeglasses and initially secure the anti-theft tag to the arm via the adhesive material. The assembler then can shrink the sleeve to further secure the anti-theft tag to the arm. As such, the adhesive material and the shrinkable sleeve minimize lateral translation of the anti-theft tag along a longitudinal axis of the article thereby limiting removal of the anti-theft tag from the arm by sliding the anti-theft tag along the longitudinal axis of the arm. Additionally, the sleeve and the adhesive holds the body of the anti-theft tag against the arm, thereby limiting the ability for a thief to remove the ant-theft tag from the pair of eyeglasses by twisting or rotating the anti-theft tag relative to the arm of the eyeglasses.

In one arrangement, an anti-theft tag includes a body constructed and arranged to support an electronic article surveillance (EAS) device, a sleeve disposed about the body, an adhesive material disposed on the body, the adhesive material configured to couple the body to at least a portion of an article. The anti-theft tag also includes a sleeve holder extending from the body, the sleeve holder constructed and arranged to hold the sleeve relative to the body such that a portion of the sleeve and a portion of the body define an aperture configured to receive at least a portion of an article. The sleeve is constructed and arranged to be positioned between a first state to allow positioning of the at least a portion of the article within the aperture and a second state to secure the body to the at least a portion of the article.

In one arrangement, an anti-theft tag includes a body constructed and arranged to support an electronic article surveillance (EAS) device, an adhesive material disposed on the body, the adhesive material configured to couple the body to at least a portion of an article, a sleeve disposed about the body, and a sleeve holder extending from the body. The sleeve holder includes a first finger disposed at a first end of the body and a second finger disposed at the first end of the body, the first finger opposing the second finger and the first finger and the second finger extending along a longitudinal axis of the body. The sleeve holder also includes a third finger disposed at a second end of the body and a fourth finger disposed at the second end of the body, the third finger opposing the fourth finger and the third finger and the fourth finger extending along the longitudinal axis of the body in a direction opposite to the first finger and the second finger. The first finger, the second finger, the third finger, and the fourth finger of the sleeve holder are constructed and arranged to hold the sleeve relative to the body such that a portion of the sleeve and a portion of the body define an aperture configured to receive at least a portion of an article. The sleeve is constructed and arranged to be positioned between a first state to allow positioning of the at least a portion of the article within the aperture and a second state to secure the body to the at least a portion of the article.

In one arrangement, an anti-theft tag includes a body constructed and arranged to support an electronic article surveillance (EAS) device, the body having an adhesive material configured to couple the body to a portion of an article and the body having an adhesive covering removeably disposed on the adhesive material, and a sleeve disposed about the body. The anti-theft tag also includes a sleeve holder extending from the body, the sleeve holder being constructed and arranged to hold the sleeve relative to the body such that a portion of the sleeve and a portion of the body define an aperture configured to receive at least the portion of the article. The sleeve is constructed and arranged to be positioned between a first state to allow positioning of the at least a portion of the article within the aperture and a second state to secure the body to the at least a portion of the article.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

Embodiments of the present invention relate to an anti-theft tag that is securable to an article, such as a pair of eyeglasses, and that minimizes the ability for a thief to readily remove the anti-theft tag from the article prior to exiting an establishment. For example, the anti-theft tag includes a body that carries an EAS sensor, a shrinkable sleeve disposed about the outside of the body, an adhesive material disposed between the body and the shrinkable sleeve, and a sleeve holder extending from the body. The sleeve holder is constructed and arranged to hold the sleeve on the body such that a portion of the sleeve and the body define an aperture configured to receive an elongate article, such as an arm from the pair of eyeglasses. The shrinkable sleeve and the adhesive material help to limit or prevent lateral translation of the anti-theft tag along a longitudinal axis of the article once secured thereto. For example, in the case where the anti-theft tag is secured to an arm of a pair of eyeglasses, the combination of the shrinkable sleeve and the adhesive material limits the ability for a thief to remove the anti-theft tag from the eyeglasses.

In use, the assembler can dispose the anti-theft tag onto the arm of the pair of eyeglasses and initially secure the anti-theft tag to the arm via the adhesive material. The assembler then can shrink the sleeve to further secure the anti-theft tag to the arm. As such, the adhesive material and the shrinkable sleeve minimize lateral translation of the anti-theft tag along a longitudinal axis of the article thereby limiting removal of the anti-theft tag from the arm by sliding the anti-theft tag along the longitudinal axis of the arm. Additionally, the sleeve and the adhesive holds the body of the anti-theft tag against the arm, thereby limiting the ability for a thief to remove the ant-theft tag from the pair of eyeglasses by twisting or rotating the anti-theft tag relative to the arm of the eyeglasses.

Figure 1:
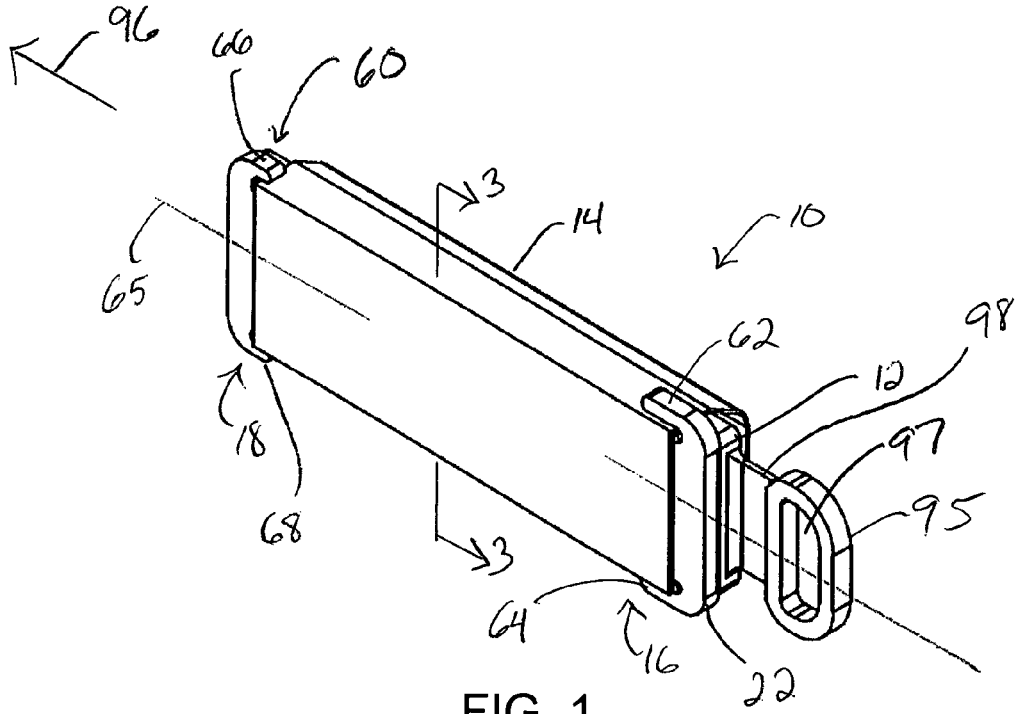
FIG. 1 is a perspective view of an anti-theft tag, according to one embodiment of the invention.
Figure 2:
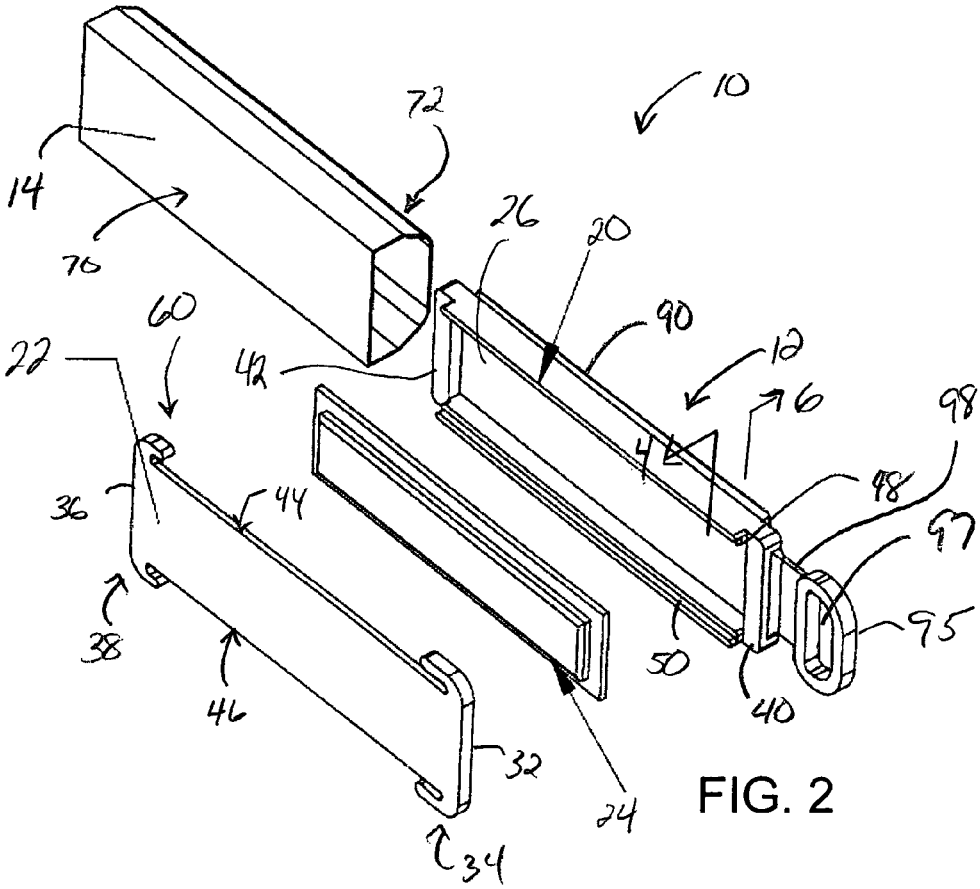
FIG. 2 is an exploded perspective view of the anti-theft tag of FIG. 1.

FIGS. 1 and 2 illustrate an embodiment of an anti-theft tag 10 having a body 12 and a sleeve 14 disposed about, and held by, the body 12. The body 12 is generally rectangular in shape and has a first end 16 and an opposing second end 18, the sleeve being disposed there between. The body 12 can be formed by an injection-molding process from a material, such as plastic. The body 12 can include a label (not shown) disposed on an outer surface of the cover. The label can be used to provide information about the product to which the anti-theft tag 10 is secured. For example, the label can include indicia which identifies the manufacturer, brand name, and/or model name of the article or a bar code that identifies the article.

The sleeve 14 is configured to secure the body 12 to an article. While the sleeve 14 can be formed from a variety of materials, in one arrangement, the sleeve 14 is formed from a heat-activated shrink wrap material, such as PVC. In use, when the sleeve 14 is configured in a non-shrunken state, an assembler inserts the article between the sleeve 14 and the body 12. The assembler then subjects the sleeve 14 to a heating process which causes the sleeve 14 to shrink and harden, thereby tightly securing the body 12 to the article.

Figure 4:
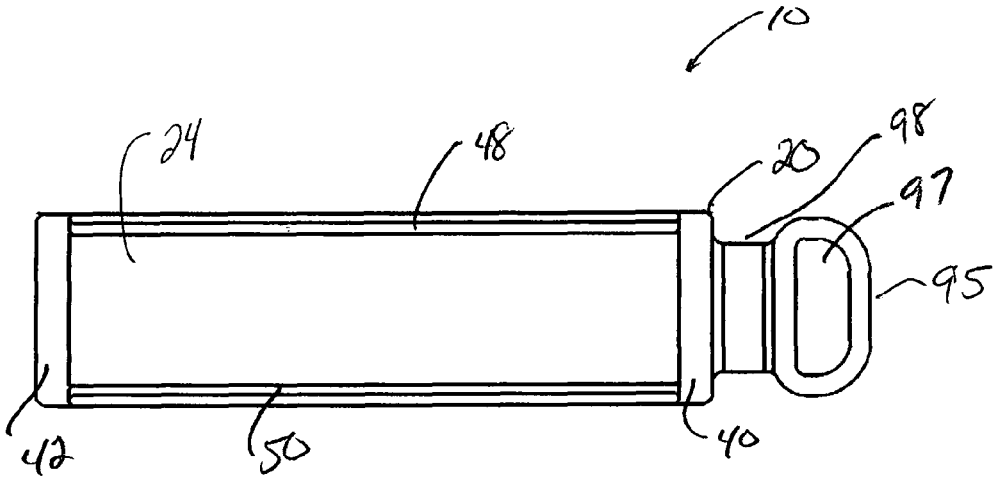
FIG. 4 is first side view of a housing of the anti-theft tag of FIG. 2.
Figure 5:
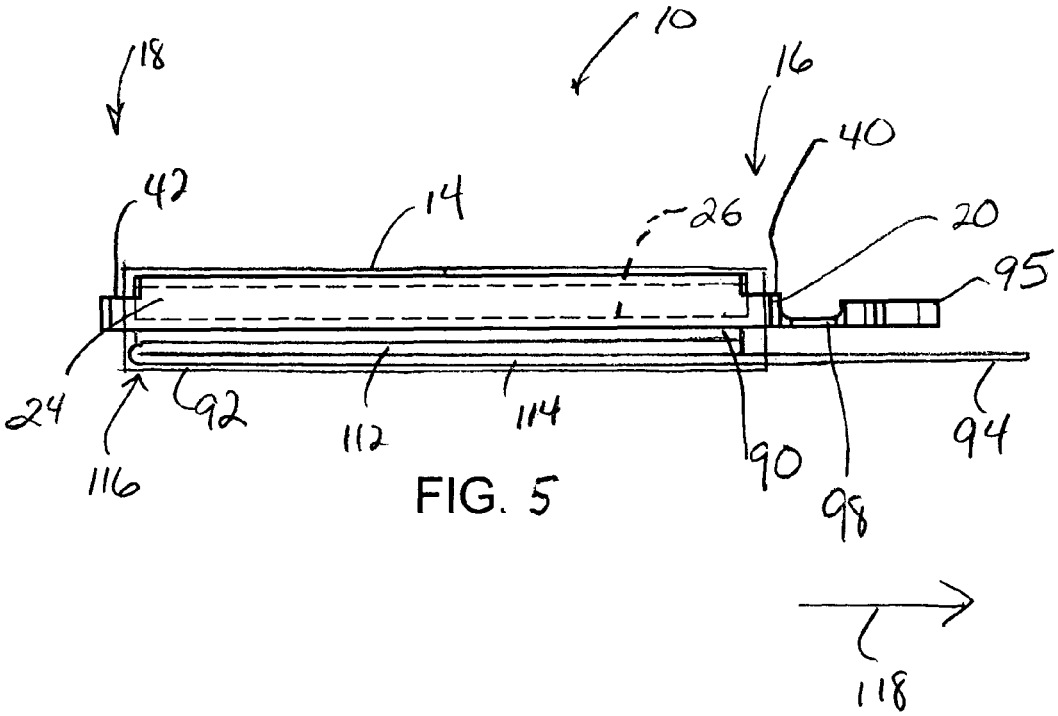
FIG. 5 is a top view of the housing of the anti-theft tag of FIG. 4.
Figure 6:
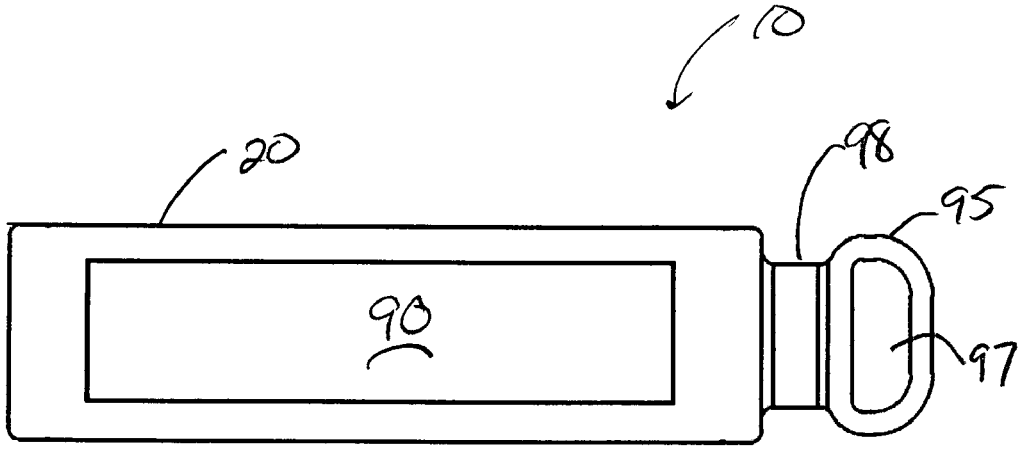
FIG. 6 is a second side view of the housing of the anti-theft tag of FIG. 2.

The body 12 includes a housing 20 and a cover 22. The housing 20 is configured to carry an electronic article surveillance (EAS) device 24, such as the type which sets off an alarm if the EAS device is carried beyond a surveillance area before the EAS device is deactivated. For example, as illustrated in FIGS. 2, 4, and 5, the housing 20 defines a cavity 26 that is sized to receive the EAS device 24. While the housing 20 can carry the EAS device 24 in a variety of ways, in one arrangement, the EAS device 24 is disposed within the cavity 26 and adhered to the housing 20 within the cavity 26.

Figure 7:
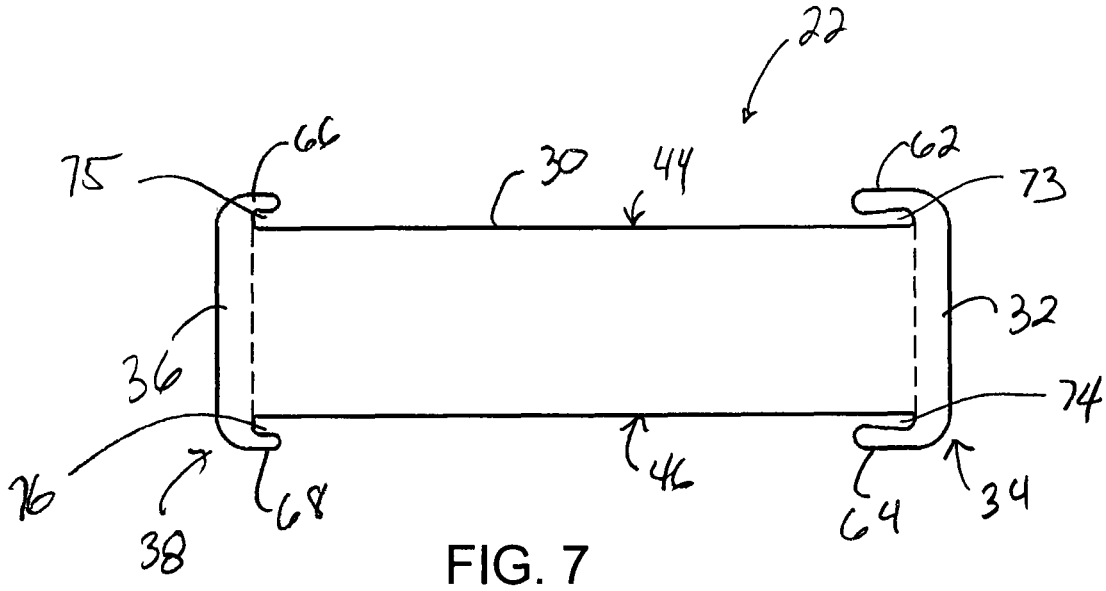
FIG. 7 illustrates a front view of the housing cover of FIG. 2.
Figure 8:
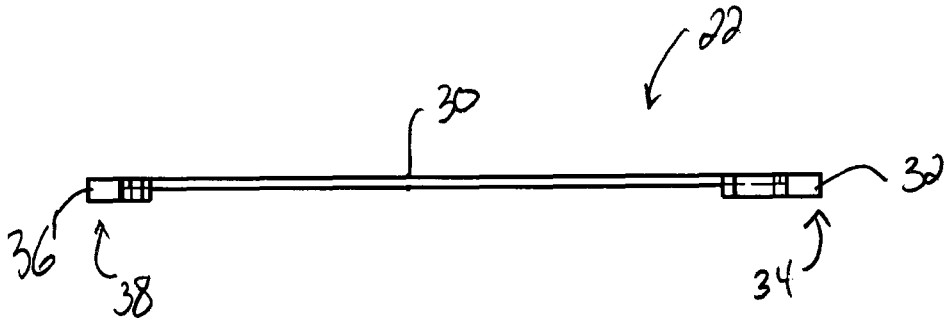
FIG. 8 illustrates a top view of the housing cover of FIG. 7.

The cover 22 is configured to couple with the housing 20 in order to conceal the EAS device 24. In one arrangement, as illustrated in FIGS. 2, 7, and 8, the cover 22 includes a plate member 30 having a first lip member 32 disposed at a first end 34 of the plate member 30 and a second lip member 36 disposed at a second end 38 of the plate member 30. As indicated in FIGS. 2, 4, and 5, the first and second lip members 32, 36 mate with first and second grooves 40, 42, respectively, defined by the housing 20 while opposing first and second edges 44, 46 of the plate member 30 mate with opposing first and second channels 48, 50 defined by the housing 20. Interaction between the housing 20 and the cover 22, in this arrangement, completely encloses the EAS device 24 within the body 12.

Returning to FIG. 1, as indicated above, the anti-theft tag 10 includes a sleeve 14 disposed about the body 12. The anti-theft tag 10 is configured to hold and help secure the sleeve 14 to the body 12 prior to an assembler securing the anti-theft tag 10 to an article. In one arrangement, the anti-theft tag 10 includes a sleeve holder 60 disposed on the body 12. For example, the sleeve holder 60 includes a first finger 62 disposed at the first end 16 of the body 12 and a second finger 64 disposed at the first end 16 of the body 12 where the first finger 62 opposes the second finger 64 relative to a longitudinal axis 65 of the body 12. The sleeve holder 60 also includes a third finger 66 disposed at the second end 18 of the body 12 and a fourth finger 68 disposed at the second end 18 of the body 12 where the third finger 66 opposes the fourth finger 68 relative to the longitudinal axis 65 of the body 12. As indicated in FIG. 1, the first and second fingers 62, 64 extend substantially parallel to each other in a first direction along the longitudinal axis 65, and the third and fourth fingers 66, 68 extend substantially parallel to each other in a second direction along the longitudinal axis 65, the second direction opposing the first direction.

Each finger 62, 64, 66, 68 defines a gap relative to the body 12. For example, as illustrated in FIG. 7, the cover 22 of the body 12 includes the fingers 62, 64, 66, 68 where each finger 62, 64, 66, 68 defines a corresponding gap 73, 74, 75, 76 relative to the cover 22 and the housing 20 (as indicated in FIG. 2). Returning to FIG. 1, the sleeve 14 is disposed within the gaps 73, 74, 75, 76 defined by the fingers 62, 64, 66, 68 such that the fingers 62, 64, 66, 68 hold the sleeve 14 about the body 12. The sleeve holder 60, therefore, limits the ability for the sleeve 14 to become separated from the body 12 prior to the anti-theft tag 10 being secured to an article.

Figure 3:
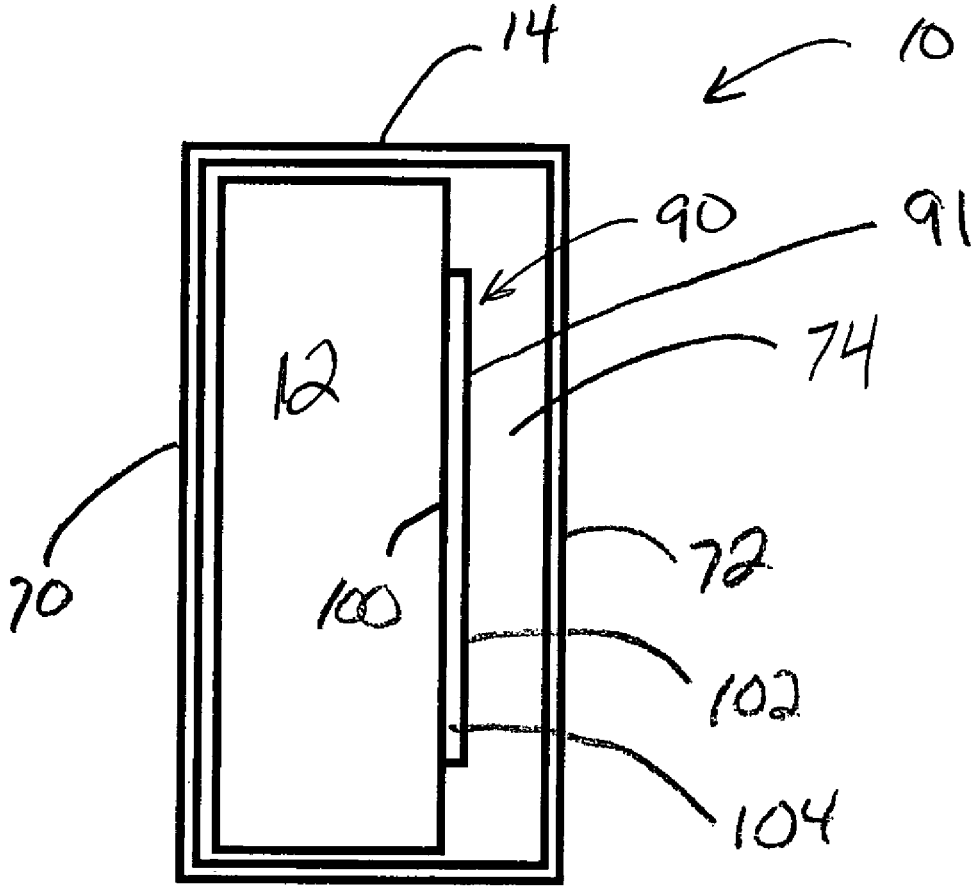
FIG. 3 is a sectional view of the anti-theft tag of FIG. 1.

In one arrangement, and with reference to FIGS. 1, 2, and 3, the fingers 62, 64, 66, 68 help to maintain a positional relationship between the sleeve 14 and the body 12 to allow the anti-theft tag 10 to be easily applied to an elongate object. For example, the fingers 62, 64, 66, 68 hold the sleeve 14 on the body 12 such that a first portion 70 of the sleeve 14 is held substantially against the cover 22 of the body 12 while a second portion 72 of the sleeve 14 defines an aperture 74 with the housing 20 of the body 12. The aperture 74 is configured to receive a portion of the elongate member for securing of the anti-theft tag 10 thereto.

With respect to the anti-theft tag 10 described above, a manufacturer can apply the anti-theft tag 10 to a wide variety of articles or elongate objects to provide the objects with a level of security. For example, the assembler can apply the anti-theft tag 10 to a pair of eyeglasses. In use, and with reference to FIG. 9, when securing the anti-theft tag 10 to a pair of eyeglasses, an assembler first inserts an arm 80 of the pair of eyeglasses (i.e., an elongate member) within the aperture 74 defined between the sleeve 14 and the body 12. As indicated above, the sleeve 14 is initially configured in a non-shrunken state to allow the assembler to position the anti-theft tag 10 along a longitudinal axis 82 of the arm 80. With this positioning, the body 12 of the anti-theft tag 10 is disposed against the arm 80 such that a longitudinal axis 65 of the anti-theft tag 10 is substantially parallel to the longitudinal axis 82 of the arm 80. Once located at a desired position along the length of the arm 80, the assembler shrinks the sleeve 14 to reduce the radial dimensions of the sleeve. For example, in the case where the sleeve 14 is formed from a heat shrinkable material, the assembler applies heat to the sleeve 14 thereby causing the sleeve 14 to shrink (i.e., reducing the radial dimensions of the sleeve 14). As the sleeve 14 shrinks, the sleeve 14 substantially conforms to a portion of the body 12 of the anti-theft tag 10 and to a portion of the arm 80 of the pair of eyeglasses, thereby securing the body 12 to the arm 80.

Figure 9:
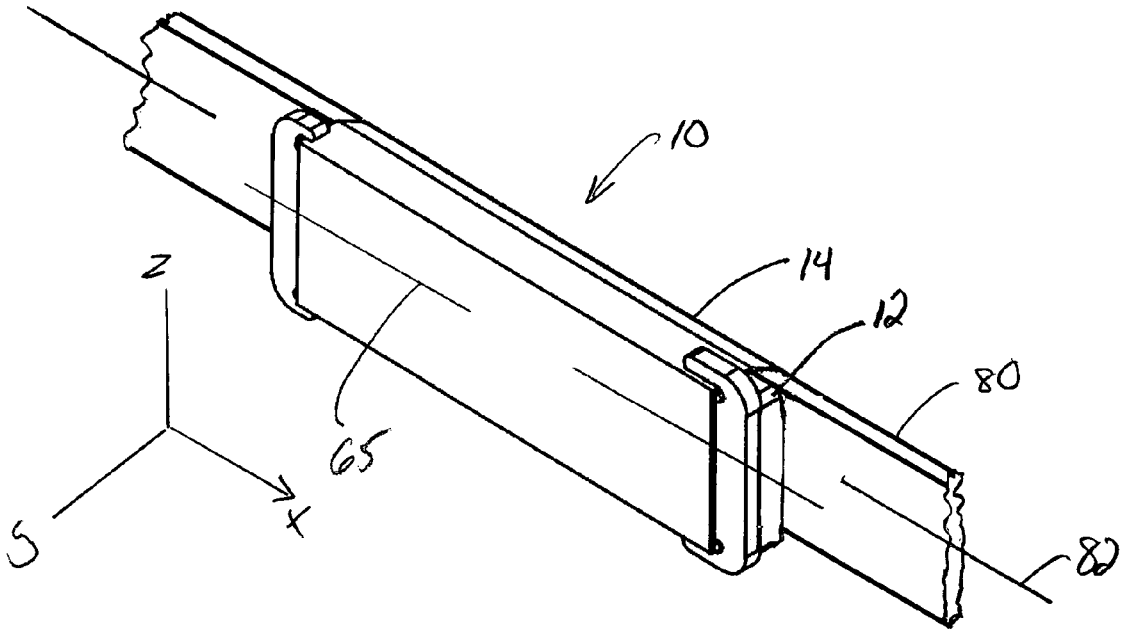
FIG. 9 illustrates an embodiment of an anti-theft tag applied to an elongate member.

The configuration of anti-theft tag 10 minimizes the ability for a thief to purposely remove the anti-theft tag 10 from the arm 80 once the anti-theft tag 10 has secured to the pair of eyeglasses. For example, as indicated in FIG. 9, once shrunken, the sleeve 14 holds the body 12 of the anti-theft tag 10 against the arm 80. Such positioning of the body 12 relative to the arm 80 limits the ability for a thief to twist or rotate the body 12 of the anti-theft tag 10 relative to the arm 80 of the eyeglasses in an attempt to separate the EAS device 24 contained within the body 12 from the pair of eyeglasses. As such, the anti-theft tag 10 provides an additional level of security to an article to which it is attached.

While the sleeve 14 is configured to secure the anti-theft tag 10 to an article, the anti-theft tag 10 can include additional securing mechanisms to help deter removal of the anti-theft tag 10 from an article prior to purchase. In one embodiment, as illustrated in FIGS. 2, 3, 5, and 6, the anti-theft tag 10 includes an adhesive material 90 disposed on the body 12 of the anti-theft tag 10 between the housing 20 and the second portion 72 of the sleeve 14. In use, after an assembler has inserted an article within the aperture 74 defined between housing 20 and the second portion 72 of the sleeve 14, the assembler makes contact between the adhesive material 90 and the article. The adhesive material 90 secures the anti-theft tag 10 to the article, such as an arm of a pair of eyeglasses, prior to an assembler shrinking the sleeve 14 of the anti-theft tag 10 to secure the anti-theft tag 10 to the article. As such, the adhesive material 90 helps the anti-theft tag 10 to maintain its position on the article during the sleeve shrinking process. Additionally, after the sleeve shrinking process, once the anti-theft tag 10 has been secured to the article, the adhesive material 90 limits or prevents lateral translation of the anti-theft tag 10 along a longitudinal axis of the article. For example, with reference to FIG. 9, the adhesive material 90 (not shown) disposed between the arm 80 of the pair of eyeglasses and the body 12, in addition to the shrunken sleeve 14, aids in securing the body 12 containing the EAS sensor to the arm. The adhesive material 90 limits the ability for a thief to slide the anti-theft tag 10 along the longitudinal axis 82 of the arm 80 and remove the anti-theft tag 10 from the pair of eyeglasses.

While a variety of adhesive materials 90 can be disposed on the anti-theft tag 10, in one arrangement and with reference to FIG. 3, the adhesive material 90 is configured as an adhesive pad 91 having opposing first and second adhesive surfaces 100, 102 and an intermediate layer 104 disposed there between. The first adhesive surface 100 is formed from a relatively strong adhesive material that is configured to secure the adhesive pad 91 to the body 12 and minimize the ability for a user to physically separate the pad 91 from the body 12. The second adhesive surface 102 is formed from a relatively weaker adhesive material and is formulated to be removed cleanly from an article to which it is attached when a user removes the anti-theft tag 10 from the article. As such, once removed, the amount of residue left by the second adhesive surface 102 on the article is minimized. Additionally, the adhesive material forming the second adhesive surface 102 can be formulated to minimize chemical interaction with the article to limit or prevent degradation or corrosion of the article once secured thereto. In one arrangement, the intermediate layer 104 separating the first and second adhesive surfaces 100, 102 is formed from a foam material. The foam material allows the adhesive pad 91 to follow or conform to a contour and minute surface irregularities of an article, such as a curved arm of a pair of eyeglasses, to which the anti-theft tag 10 is attached. As such, the foam material 104 helps to maximize the strength of the bond between the second adhesive surface 102 and the article.

In one arrangement, as shown in FIG. 5, the adhesive material 90 includes an adhesive covering 92, such as a plastic film, disposed on the adhesive material 90 configured to protect the adhesive material 90 and minimize contact between the adhesive material 90 and an article during an assembly process. For example, when an assembler inserts an article into the aperture 74 defined by the anti-theft tag 10, the adhesive covering 92 allows the article to slide within the aperture 74 relative to the adhesive material 90. Once the assembler has positioned the anti-theft tag 10 in a particular position relative to the article, the assembler removes the adhesive covering 92 from the adhesive material 90, such as by pulling on a free end 94 of the adhesive covering 92 to expose the adhesive material 90 and allow contact between the adhesive material 90 and the article.

While the adhesive covering 92 can be arranged in a variety of ways, in one arrangement as indicated in FIG. 5, the adhesive covering 92 is formed of a single strip of material having a first portion 112 disposed on the adhesive material 90 and a second portion 114 that is folded over the first portion 112. As shown, the second portion 114 of the adhesive covering 92 forms a 180 degree turn 116 relative to the first portion 114 such that the free end 94 of the adhesive covering 92 extends beyond the first end 16 of the body 20, external to the sleeve 14 of the anti-theft tag 10. Because the adhesive covering 92 is configured in such a manner with the free end 94 extending beyond the sleeve 14 of the anti-theft tag 10, the adhesive covering 92 allows a user to easily remove the adhesive covering 92 from the adhesive material 90 when needed. For example, an assembler first inserts an article into the aperture 74 defined by the anti-theft tag 10 and positions the anti-theft tag 10 in a particular position relative to the article. The assembler then removes the adhesive covering 92 from the adhesive material 90 by pulling the free end 94 of the adhesive covering 92 along direction 118, thereby causing the second portion 114 to slide relative to the first portion 112 along the direction 118 to remove the first portion 112 of the adhesive covering 92 from the adhesive material 90. This motion exposes the adhesive material 90 to the article thereby allowing the assembler to secure the anti-theft tag 10 to the article.

While various embodiments of the invention have been particularly shown and described, it will be understood by those skilled in the art that various changes in form and details may be made therein without departing from the spirit and scope of the invention as defined by the appended claims.

For example, as indicated above with respect to FIG. 9, the anti-theft tag 10 can be secured to an article such as an arm 80 of a pair of eyeglasses. In certain cases, the arm is formed with a substantially curved shape along the longitudinal axis 82 (e.g., relative to the X-Z plane). To provide adequate coupling of the anti-theft tag 10 to a curved article, in one embodiment as illustrated in FIGS. 1, 2, and 4 through 6, the anti-theft tag 10 includes a coupling member 95 extending from the first end 16 of the body 12. The coupling member 95 is configured to capture a portion of the curved article and direct or pull the first end 16 of the body 12 toward the curved article. As such, the coupling member 95 causes the first end 16 of the body 12 of the anti-theft tag 10 to lie in proximity to the curved article, thereby limiting the ability for a thief to rotate the body 12 relative to the curved article in order to physically separate the anti-theft tag 10 from the article.

In one arrangement, the coupling member 95 defines an aperture 97 that is substantially aligned with the aperture 74 defined by the sleeve 14 and the body 12. The coupling member 95 is attached to the first end 16 of the body 12 by a flexible material portion 98. The flexible material 98 allows the coupling member 95 to rotate relative to the body 12 to generate a pulling force on a curved article when the anti-theft tag 10 is attached to the curved article. In use, and with reference to FIG. 1, an assembler slides the anti-theft tag 10 onto a curved article, such as an arm of a pair of eyeglasses, along direction 96 such that the curved article is inserted within the aperture 74 between the sleeve 14 and the body 12. As the assembler positions a free end of the curved article in proximity to the coupling member 95, the assembler inserts the free end of the curved article into the aperture 95 of the coupling member 95. Further motion of the anti-theft tag 10 along direction 96 causes the coupling member 95 to rotate relative to the body 12 (e.g., towards the curved article) about the flexible material portion 98. Such rotation causes the coupling member 95 to generate a load on the first end 16 of the body 12 in order to position the first end 16 of the body in proximity to the curved article.

As indicated above, when securing the anti-theft tag 10 to a pair of eyeglasses, an assembler first inserts an arm 80 of the pair of eyeglasses (i.e., an elongate member) within the aperture 74 defined between the sleeve 14 and the body 12. The assembler then locates the anti-theft tag at a desired position along the length of the arm 80 and causes the sleeve 14 to shrink to secure the anti-theft tag 10 to the arm 80. While the assembler can position the anti-theft tag 10 at any location along the length of the arm 80, in one arrangement, the assembler positions the anti-theft tag 10 on the arm 80 such that a portion of the sleeve 14 is disposed about a hinge of the arm 80, (e.g., the hinge connecting the arm 80 to the frame of the pair of eyeglasses).

What is claimed is:

1. An anti-theft tag, comprising:

a body constructed and arranged to support an electronic article surveillance (EAS) device the body including a housing and a cover, the cover having a first end and an opposing second end;

a sleeve disposed about both the housing and cover;

an adhesive material disposed on the body, the adhesive material configured to couple the body to at least a portion of an article; and a sleeve holder extending from the first end of the cover and the second end of the cover, the sleeve holder constructed and arranged to hold the sleeve relative to the body such that a portion of the sleeve and a portion of the body define an aperture configured to receive the at least a portion of an article; and wherein the sleeve is constructed and arranged to be positioned between (i) a first state to allow positioning of the at least a portion of the article within the aperture and (ii) a second state to secure the body to the at least a portion of the article.

2. The anti-theft tag of claim 1, comprising an adhesive covering removeably disposed on the adhesive material.

3. The anti-theft tag of claim 2, wherein the adhesive covering comprises a single strip of material having a first portion disposed on the adhesive material and a second portion folded over the first portion wherein the second portion of the adhesive covering forms a 180 degree turn relative to the first portion such that a free end of the adhesive covering extends beyond a first end of the body, external to the sleeve.

4. The anti-theft tag of claim 1, wherein the adhesive material is configured as an adhesive pad having a first adhesive surface, a second adhesive surface opposing the first adhesive surface, and an intermediate layer disposed between the first adhesive surface and the second adhesive surface, the first adhesive surface being formed from a first adhesive material having a first adhesive strength, the first adhesive material configured to secure the adhesive pad to the body and the second adhesive surface being formed from a second adhesive material having a second adhesive strength, the second adhesive material configured to secure the adhesive pad to the article, the first adhesive strength being greater than the second adhesive strength.

5. The anti-theft tag of claim 1, wherein the sleeve holder comprises:

a first finger disposed at a first end of the cover and a second finger disposed at the first end of the cover, the first finger opposing the second finger and the first finger and the second finger extending along a longitudinal axis of the cover; and a third finger disposed at a second end of the cover and a fourth finger disposed at the second end of the cover, the third finger opposing the fourth finger and the third finger and the fourth finger extending along the longitudinal axis of the cover in a direction opposing the first finger and the second finger;

wherein the first finger, the second finger, the third finger, and the fourth finger carry the sleeve such that the sleeve is disposed about the cover and housing.

6. The anti-theft tag of claim 1, comprising a coupling member extending from a first end of the body, the coupling member defining an aperture substantially aligned with the aperture defined by the portion of the sleeve and the portion of the body, the coupling member being constructed and arranged to receive the at least a portion of the article and to direct the first end of the body toward the at least a portion of the article.

7. The anti-theft tag of claim 1, wherein the sleeve is formed from a heat shrinkable material and wherein the sleeve is constructed and arranged to be positioned between (i) a non-shrunken state to allow positioning of the portion of the article within the aperture and (ii) a shrunken state to secure the body to the portion of the article.

8. The anti-theft tag of claim 1, further comprising an EAS device carried by the housing.

9. The anti-theft tag of claim 8, wherein the housing includes a recess, the EAS device being disposed within the recess.

10. The anti-theft tag of claim 9, wherein the cover covers the EAS device.

11. An anti-theft tag, comprising:

a body constructed and arranged to support an electronic article surveillance (EAS) device;

an adhesive material disposed on the body, the adhesive material configured to couple the body to at least a portion of an article; and a sleeve disposed about the body; and a sleeve holder extending from the body, the sleeve holder having:

a first finger disposed at a first end of the body and a second finger disposed at the first end of the body, the first finger opposing the second finger and the first finger and the second finger extending along a longitudinal axis of the body, and a third finger disposed at a second end of the body and a fourth finger disposed at the second end of the body, the third finger opposing the fourth finger and the third finger and the fourth finger extending along the longitudinal axis of the body in a direction opposite to the first finger and the second finger, wherein the first finger, the second finger, the third finger, and the fourth finger of the sleeve holder are constructed and arranged to hold the sleeve relative to the body such that a portion of the sleeve and a portion of the body define an aperture configured to receive at least a portion of an article, and wherein the sleeve is constructed and arranged to be positioned between (i) a first state to allow positioning of the at least a portion of the article within the aperture and (ii) a second state to secure the body to the at least a portion of an article.

12. The anti-theft tag of claim 11, comprising an adhesive covering removeably disposed on the adhesive material.

13. The anti-theft tag of claim 12, wherein the adhesive covering comprises a single strip of material having a first portion disposed on the adhesive material and a second portion folded over the first portion wherein the second portion of the adhesive covering forms a 180 degree turn relative to the first portion such that a free end of the adhesive covering extends beyond a first end of the body, external to the sleeve.

14. The anti-theft tag of claim 11, wherein the adhesive material is configured as an adhesive pad having a first adhesive surface, a second adhesive surface opposing the first adhesive surface, and an intermediate layer disposed between the first adhesive surface and the second adhesive surface, the first adhesive surface being formed from a first adhesive material having a first adhesive strength, the first adhesive material configured to secure the adhesive pad to the body and the second adhesive surface being formed from a second adhesive material having a second adhesive strength, the second adhesive material configured to secure the adhesive pad to the article, the first adhesive strength being greater than the second adhesive strength.

15. The anti-theft tag of claim 11, comprising a coupling member extending from a first end of the body, the coupling member defining an aperture substantially aligned with the aperture defined by the portion of the sleeve and the portion of the body, the coupling member being constructed and arranged to receive the at least a portion of the article and to direct the first end of the body toward the at least a portion of the article.

16. The anti-theft tag of claim 11, wherein the sleeve is formed from a heat shrinkable material and wherein the sleeve is constructed and arranged to be positioned between (i) a non-shrunken state to allow positioning of the at least a portion of the article within the aperture and (ii) a shrunken state to secure the body to the at least a portion of the article.

17. The anti-theft tag of claim 11, further comprising an EAS device carried by the body.

18. The anti-theft tag of claim 17, wherein the body comprises a housing defining a recess, the EAS device being disposed within the recess.

19. The anti-theft tag of claim 18, further comprising a cover disposed on the housing such that the cover covers the EAS device.

20. An anti-theft tag, comprising:

a body constructed and arranged to support an electronic article surveillance (EAS) device the body including a first end and an opposing second end, the body also having an adhesive material configured to couple the body to a portion of an article and the body having an adhesive covering removeably disposed on the adhesive material;

a sleeve disposed about the body; and a sleeve holder extending from the first end of the body and the second end of the body, the sleeve holder being constructed and arranged to hold the sleeve relative to the body such that a portion of the sleeve and a portion of the body define an aperture configured to receive at least the portion of the article;

wherein the sleeve is constructed and arranged to be positioned between (i) a first state to allow positioning of the at least a portion of the article within the aperture and (ii) a second state to secure the body to the at least a portion of the article.

21. The anti-theft tag of claim 20, wherein the adhesive covering comprises a single strip of material having a first portion disposed on the adhesive material and a second portion folded over the first portion wherein the second portion of the adhesive covering forms a 180 degree turn relative to the first portion such that a free end of the adhesive covering extends beyond a first end of the body, external to the sleeve.

22. The anti-theft tag of claim 20, wherein the adhesive material is configured as an adhesive pad having a first adhesive surface, a second adhesive surface opposing the first adhesive surface, and an intermediate layer disposed between the first adhesive surface and the second adhesive surface, the first adhesive surface being formed from a first adhesive material having a first adhesive strength, the first adhesive material configured to secure the adhesive pad to the body and the second adhesive surface being formed from a second adhesive material having a second adhesive strength, the second adhesive material configured to secure the adhesive pad to the article, the first adhesive strength being greater than the second adhesive strength.

* * * * *